US012799881B2

(12) United States Patent
Yu et al.

(10) Patent No.: US 12,799,881 B2
(45) Date of Patent: Nov. 17, 2026

(54) ENGINE OIL REPLACEMENT CYCLE OPTIMIZATION APPARATUS AND METHOD

(71) Applicants: HYUNDAI MOTOR COMPANY, Seoul (KR); KIA CORPORATION, Seoul (KR)

(72) Inventors: Jungmo Yu, Hwaseong-si (KR); Jeawan Kim, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 19/215,673

(22) Filed: May 22, 2025

(65) Prior Publication Data

US 2026/0168415 A1 Jun. 18, 2026
US 2026/0309065 A1 Oct. 8, 2026

(30) Foreign Application Priority Data

Dec. 13, 2024 (KR) ..... 10-2024-0185592

(51) Int. Cl.
*F01M 11/10* (2006.01)

(52) U.S. Cl.
CPC ..... *F01M 11/10* (2013.01); *F01M 2011/1413* (2013.01); *F01M 2011/1426* (2013.01)

(58) Field of Classification Search
CPC ..... F01M 11/10; F01M 2011/14; F01M 2011/142; F01M 2011/1426; F01M 2011/1486
See application file for complete search history.

(56) References Cited

U.S. PATENT DOCUMENTS 4,847,768 A * 7/1989 Schwartz ..... G07C 5/006 701/29.5
9,424,751 B2 * 8/2016 Hodges ..... G08G 1/0967
2020/0152067 A1 * 5/2020 Salles ..... G07C 5/008
2022/0284470 A1 * 9/2022 Gee ..... G06Q 30/0251

FOREIGN PATENT DOCUMENTS

CN 115795270 A * 3/2023
JP 2023087251 A * 6/2023

* cited by examiner

*Primary Examiner* — George C Jin
*Assistant Examiner* — Teuta B Holbrook
(74) *Attorney, Agent, or Firm* — MCDONNELL BOEHNEN HULBERT & BERGHOFF LLP

(57) ABSTRACT

An engine oil replacement cycle optimization method is provided. The method includes receiving vehicle operation information including at least the mileage, operation time, vehicle speed and revolutions per minute (RPM) information of a driver vehicle. The method also includes collecting driver engine oil replacement tendency data based on the mileage, and calculating an engine oil replacement cycle of the driver vehicle based on at least one of the vehicle operation information or the engine oil replacement tendency data.

16 Claims, 8 Drawing Sheets

ENGINE OIL REPLACEMENT CYCLE OPTIMIZATION APPARATUS AND METHOD

CROSS-REFERENCE TO RELATED APPLICATION(S)

This application claims priority to and the benefit of Korean Patent Application No. 10-2024-0185592 filed with the Korean Intellectual Property Office on Dec. 13, 2024, the entire contents of which are incorporated herein by reference.

TECHNICAL FIELD

The present disclosure relates to an engine oil replacement cycle optimization apparatus and method, and more particularly, to an engine oil replacement cycle optimization apparatus and method for optimizing and recommending a vehicle engine oil replacement cycle based on a driver characteristic.

BACKGROUND

A conventional method for providing an engine oil inspection/replacement cycle based on mileage may not be optimized as this method uses only simple mileage data. In addition, the conventional method may have a limitation that a replacement cycle may be unknown if engine oil inspection/replacement was not performed at an official direct store.

That is, the conventional recommendation services may have two issues. First, a previous replacement period may not be updated if the engine oil inspection/replacement is not performed at an official service center. Second, the replacement cycle recommendation may be made only based on simple mileage.

Therefore, the conventional method for providing the engine oil inspection/replacement cycle does not account for differences in the engine oil replacement period based on customer tendencies or preferences.

SUMMARY

The present disclosure provides an engine oil replacement cycle optimization apparatus and method for recommending an (e.g., optimal) engine oil replacement cycle to a driver by deriving the replacement cycle based on a driver tendency and operation data of a driver vehicle.

The present disclosure provides an engine oil replacement cycle optimization apparatus and method for increasing driver convenience by recommending a suitable repair shop to a driver using optimal engine oil replacement cycle data.

According to an example embodiment, provided is an engine oil replacement cycle optimization method including receiving vehicle operation information including at least the mileage, operation time, vehicle speed, and revolutions per minute (RPM) information of a driver vehicle, collecting driver engine oil replacement tendency data based on the mileage, and calculating an engine oil replacement cycle of the driver vehicle based on at least one of the vehicle operation information or the engine oil replacement tendency data.

The receiving of the vehicle operation information may include receiving an average driving RPM of the driver vehicle, an average driving RPM of a vehicle in a class of (e.g., the same) vehicles, and/or the number of sudden accelerations by the driver vehicle per 100 kilometers (km) of driving.

The collecting of the driver engine oil replacement tendency data based on the mileage may include collecting first tendency data as the driver engine oil replacement tendency data when an average engine oil replacement period of a driver is shorter than the replacement cycle stored in the vehicle, collecting second tendency data when the average engine oil replacement period of the driver is longer than the stored replacement cycle, and collecting third tendency data when the stored replacement cycle and the average engine oil replacement period of the driver are the same (e.g., as each other).

The calculating of the engine oil replacement cycle of the driver vehicle may include individually calculating a first engine oil replacement cycle of the driver vehicle based on any one of the first tendency data, the second tendency data, or the third tendency data.

The calculating of the engine oil replacement cycle of the driver vehicle may include calculating a second engine oil replacement cycle converted into the mileage of the driver vehicle using Equation 1 of $P=A\times(C/B)\times(1+0.001\times D)$, where P indicates the second engine oil replacement cycle converted into the mileage, A indicates a value of the replacement cycle stored in the vehicle or the first engine oil replacement cycle converted into the mileage, B indicates the average driving RPM of the vehicle in the same class, C indicates the average driving RPM of the driver vehicle, and D indicates the number of sudden accelerations by the driver vehicle per 100 km.

The method may further include receiving air quality data collected from the vehicle, wherein the calculating of the engine oil replacement cycle of the driver vehicle includes calculating the engine oil replacement cycle of the driver vehicle based on the driver engine oil replacement tendency data, the vehicle operation information, or the air quality data.

The calculating of the engine oil replacement cycle of the driver vehicle may include calculating a third engine oil replacement cycle converted into the mileage using Equation 2 of $P=A\times(C/B)\times(1+0.001\times(D+E))$, where P indicates the third engine oil replacement cycle converted into the mileage, A indicates a value of the replacement cycle stored in the vehicle or the first engine oil replacement cycle converted into the mileage, B indicates the average driving RPM of the vehicle in the same class, C indicates the average driving RPM of the driver vehicle, D indicates the number of sudden accelerations by the driver vehicle per 100 km, and E indicates the air quality data.

The method may further include determining that the driver vehicle is due for (e.g., requires) engine oil replacement if a current mileage of the driver vehicle is equal to or greater than the first engine oil replacement cycle converted into the mileage or the second engine oil replacement cycle converted into the mileage.

The method may further include searching for a driver-preferred repair shop on a route and providing the corresponding shop to the driver based on repair shop preference data of the driver that is included in the collected driver engine oil replacement tendency data and currently set navigation destination information of the driver vehicle if it is determined that the engine oil replacement is due (e.g., necessary).

The method may further include receiving the vehicle operation information, the driver engine oil replacement tendency data, a first engine oil replacement cycle and a second engine oil replacement cycle from the driver vehicle and storing the received information in an integrated database.

According to an embodiment, provided is an engine oil replacement cycle optimization apparatus. The apparatus includes a vehicle operation information receiving unit for receiving vehicle operation information including at least the mileage, operation time, vehicle speed and revolutions per minute (RPM) information of a driver vehicle, a driver tendency collection unit for collecting driver engine oil replacement tendency data based on the mileage, and an engine oil replacement period determination unit for calculating an engine oil replacement cycle of the driver vehicle based on at least one of the vehicle operation information or the engine oil replacement tendency data.

The vehicle operation information receiving unit may receive an average driving RPM of the driver vehicle, an average driving RPM of a vehicle in the same class, and/or the number of sudden accelerations by the driver vehicle per 100 km of driving.

The driver tendency collection unit may receive first tendency data as the driver engine oil replacement tendency data when an average engine oil replacement period of a driver is shorter than the replacement cycle stored in the vehicle, second tendency data when the average engine oil replacement period of the driver is longer than the stored replacement cycle, and third tendency data when the stored replacement cycle and the average engine oil replacement period of the driver are the same (e.g., as each other).

The engine oil replacement period determination unit may (e.g., individually) calculate a first engine oil replacement cycle of the driver vehicle based on (e.g., any) one of the first tendency data, the second tendency data, or the third tendency data.

The engine oil replacement period determination unit may calculate a second engine oil replacement cycle converted into the mileage of the driver vehicle using Equation 1 of $$P=A\times(C/B)\times(1+0.001\times D),$$

wherein P indicates the second engine oil replacement cycle converted into the mileage, A indicates a value of the replacement cycle stored in the vehicle or the first engine oil replacement cycle converted into the mileage, B indicates the average driving RPM of the vehicle in the same class, C indicates the average driving RPM of the driver vehicle, and D indicates the number of sudden accelerations by the driver vehicle per 100 km.

The vehicle operation information receiving unit may receive air quality data collected from the vehicle. The engine oil replacement period determination unit may calculate a third engine oil replacement cycle of the driver vehicle based on the driver engine oil replacement tendency data, the vehicle operation information, or the air quality data.

The engine oil replacement period determination unit may calculate the third engine oil replacement cycle converted into the mileage using Equation 2 of $$P=A\times(C/B)\times(1+0.001\times(D+E)),$$

wherein P indicates the third engine oil replacement cycle converted into the mileage, A indicates a value of the replacement cycle stored in the vehicle or the first engine oil replacement cycle converted into the mileage, B indicates the average driving RPM of the vehicle in the same class, C indicates the average driving RPM of the driver vehicle, D indicates the number of sudden accelerations by the driver vehicle per 100 km, and E indicates the air quality data.

The apparatus may further include a repair shop recommendation unit for determining that the driver vehicle is due for (e.g., requires) engine oil replacement if a current mileage of the driver vehicle is equal to or greater than the first engine oil replacement cycle converted into the mileage or the second engine oil replacement cycle converted into the mileage.

The repair shop recommendation unit may search for a driver-preferred repair shop on a route and provide the corresponding shop to the driver based on repair shop preference data of the driver that is included in the collected driver engine oil replacement tendency data and (e.g., currently) set navigation destination information of the driver vehicle if it is determined that the engine oil replacement is suggested or due (e.g., necessary).

The vehicle operation information, the driver engine oil replacement tendency data, a first engine oil replacement cycle, and a second engine oil replacement cycle may be received from the driver vehicle and stored in an integrated database.

The engine oil replacement cycle optimization apparatus and method according to an embodiment of the present disclosure may recommend the (e.g. optimal) engine oil replacement cycle to the driver by deriving the replacement cycle based on the driver tendency and the operation data of the driver vehicle.

The present disclosure provides an engine oil replacement cycle (e.g., optimization) apparatus and method for increasing driver convenience by recommending a suitable repair shop to a driver using (e.g., optimal) engine oil replacement cycle data.

DETAILED DESCRIPTION

Figure 1:
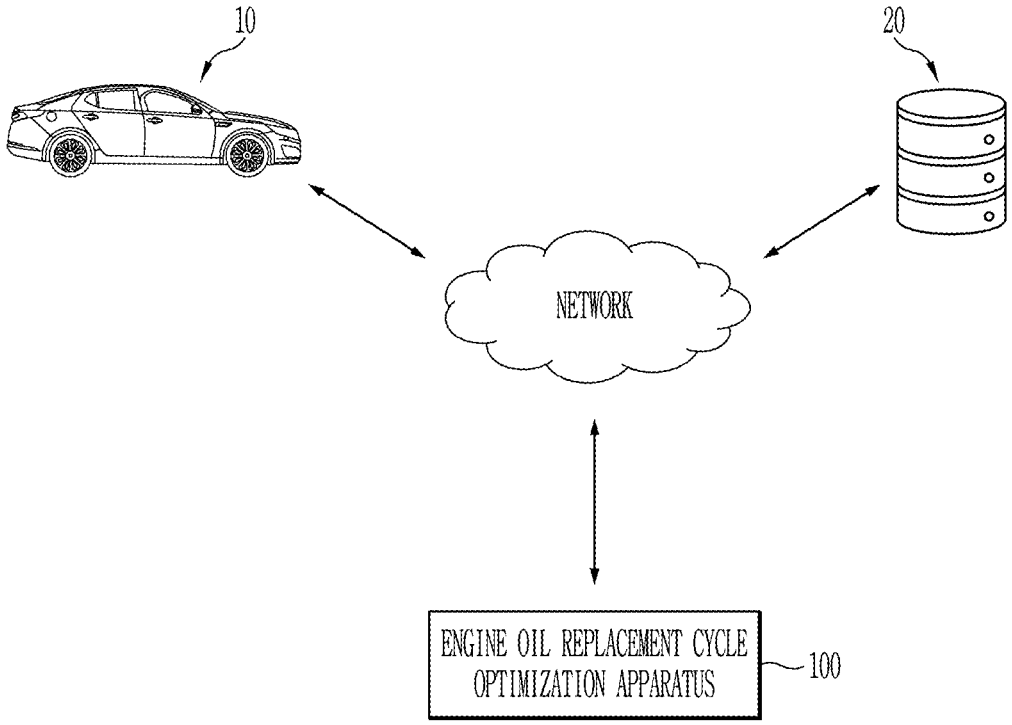
FIG. 1 schematically shows an engine oil replacement cycle optimization system according to an embodiment of the present disclosure.

Hereinafter, embodiments of the present disclosure are described in detail with reference to the accompanying drawings so that those skilled in the art to which the present disclosure pertains may (e.g., easily) practice the present disclosure. However, the present disclosure may be implemented in various different forms and is not limited to the embodiments provided herein. In addition, in the drawings, portions unrelated to the description may be omitted to describe the present disclosure, and similar portions are denoted by similar reference numerals throughout the specification.

Through the specification and claims, "including" any components will be understood to imply the inclusion of another component rather than the exclusion of another component unless described otherwise. Terms including ordinal numbers such as "first" and "second" may be used to describe various components. However, these components are not limited to these terms. These terms are used to distinguish one component and another component from each other.

Terms such as "~part", "~er/or", and "module" described in the specification may refer to a unit capable of processing at least one function or operation described in the specification, which may be implemented as hardware, a circuit, software, or a combination of hardware or circuit and software.

Hereinafter, the embodiments of the present disclosure are described with reference to the accompanying drawings.

FIG. 1 schematically shows an engine oil replacement cycle optimization system according to an embodiment of the present disclosure.

Referring to FIG. 1, the engine oil replacement cycle optimization system may include an engine oil replacement cycle optimization apparatus 100, a driver vehicle 10, and an integrated database 20.

The engine oil replacement cycle optimization apparatus 100, the driver vehicle 10, and the integrated database 20 may be connected to one another through a wired or wireless network.

The engine oil replacement cycle optimization apparatus 100 may provide (e.g., optimize) an engine oil replacement period of the driver vehicle 10 based on vehicle operation information and driver tendency, store related information and vehicle data, and provide the (e.g., optimal) period to another company using the integrated database 20.

The engine oil replacement cycle optimization apparatus 100 may suggest a more reasonable engine oil replacement cycle than a formally specified (e.g., pre-specified) mileage-based replacement cycle stored in the existing driver vehicle 10.

The engine oil replacement cycle optimization apparatus 100 may provide driver information and vehicle information to an engine oil sales/repair shop by using the integrated database 20.

That is, the engine oil replacement cycle optimization apparatus 100 may execute a scenario for utilizing the driver information, vehicle information, and optimal engine oil replacement cycle information based on the integrated database 20 by providing the same information to another company, such as an engine oil repair shop.

The driver vehicle 10 may provide the engine oil replacement cycle optimization apparatus 100 and/or the database 20 with the vehicle operation information including a mileage, an operation time, an engine idle time, a vehicle speed, and revolutions per minute (RPM) information stored in the vehicle, the driver information, and the vehicle information.

The integrated database 20 may be a control server of the driver vehicle 10. The integrated database 20 may be connected to a plurality of driver vehicles 10 to (e.g., thus) provide or receive (e.g., necessary) information to or from the driver vehicles 10 in real time and store the same.

That is, the integrated database 20 may receive the vehicle operation information, driver engine oil replacement tendency data, and an engine oil replacement cycle from the driver vehicle and store the same.

Figure 2:
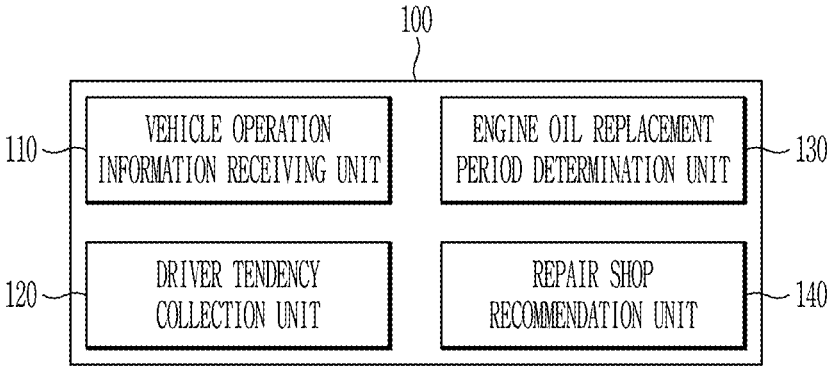
FIG. 2 is a block diagram of an engine oil replacement cycle optimization apparatus according to an embodiment of the present disclosure.

FIG. 2 is a block diagram of the engine oil replacement cycle optimization apparatus according to an embodiment of the present disclosure.

Referring to FIG. 2, the engine oil replacement cycle optimization apparatus 100 may include a vehicle operation information receiving unit 110, a driver tendency collection unit 120, an engine oil replacement period determination unit 130, and a repair shop recommendation unit 140.

The vehicle operation information receiving unit 110 may receive the vehicle operation information including at least the mileage, operation time, vehicle speed and RPM information of the driver vehicle.

The vehicle operation information receiving unit 110 may receive an average driving RPM of the driver vehicle, an average driving RPM of a vehicle in the same class, and the number of sudden accelerations by the driver vehicle per 100 km of driving.

The vehicle operation information receiving unit 110 may receive air quality data collected from the vehicle. The air quality data may include data that evaluates air quality by measuring a concentration of pollutants in the air.

The driver tendency collection unit 120 may collect the driver engine oil replacement tendency data based on the mileage from the vehicle.

The driver engine oil replacement tendency data may be data calculated by considering an engine oil replacement frequency (e.g., of a driver), the replacement cycle, an engine oil type, a vehicle type, a driving environment, a total mileage, driving habits, or the like, and may be a value converted into a specific mileage for each driver.

For example, the driver engine oil replacement tendency data may be converted into an average value of the engine oil replacement cycle of the driver.

The driver tendency collection unit 120 may receive first tendency data when an average engine oil replacement period (e.g., of the driver) is shorter than the replacement cycle stored in the vehicle based on the mileage.

The driver tendency collection unit 120 may receive second tendency data when the average engine oil replacement period of the driver is longer than the stored replacement cycle.

The driver tendency collection unit 120 may receive third tendency data as the driver engine oil replacement tendency data when the stored replacement cycle and the average engine oil replacement period of the driver are the same (e.g., as each other).

The engine oil replacement period determination unit 130 may calculate the engine oil replacement cycle of the driver vehicle based on at least one of the vehicle operation information or the engine oil replacement tendency data.

The engine oil replacement period determination unit 130 may calculate a first engine oil replacement cycle of the driver vehicle based on (e.g., any) one of the first tendency data, the second tendency data, or the third tendency data.

The engine oil replacement period determination unit 130 may calculate a second engine oil replacement cycle converted into the mileage of the driver vehicle using Equation 1 below.

Equation 1 is $P=A\times(C/B)\times(1+0.001\times D)$

In Equation 1, P indicates the second engine oil replacement cycle converted into the mileage, A indicates a value of the mileage-based replacement cycle stored in the vehicle or the first engine oil replacement cycle converted into the mileage, B indicates the average driving RPM of the vehicle in the same class, C indicates the average driving RPM of the driver vehicle, and D indicates the number of sudden accelerations by the driver vehicle per 100 km.

In another embodiment, the engine oil replacement period determination unit 130 may calculate a third engine oil replacement cycle of the driver vehicle based on the driver engine oil replacement tendency data, the vehicle operation information, or the air quality data.

That is, the engine oil replacement period determination unit 130 may calculate the third engine oil replacement cycle converted into the mileage using Equation 2.

Equation 2 is $P=A\times(C/B)\times(1+0.001\times(D+E))$

In Equation 2, P indicates the third engine oil replacement cycle converted into the mileage, A indicates the value of the mileage-based replacement cycle stored in the vehicle or the first engine oil replacement cycle converted into the mileage, B indicates the average driving RPM of the vehicle in the same class, C indicates the average driving RPM of the driver vehicle, D indicates the number of sudden accelerations by the driver vehicle per 100 km, and E indicates the air quality data.

The repair shop recommendation unit 140 may determine that the driver vehicle is due for (e.g., requires) engine oil replacement if a current mileage of the driver vehicle is equal to or greater than the first engine oil replacement cycle converted into the mileage or the second engine oil replacement cycle converted into the mileage.

The repair shop recommendation unit 140 may search for a driver-preferred repair shop on a route and provide the corresponding shop to the driver based on repair shop preference data of the driver that is included in the collected driver engine oil replacement tendency data and (e.g., currently) set navigation destination information of the driver vehicle if it is determined that the engine oil replacement is due (e.g., necessary).

Figure 3:
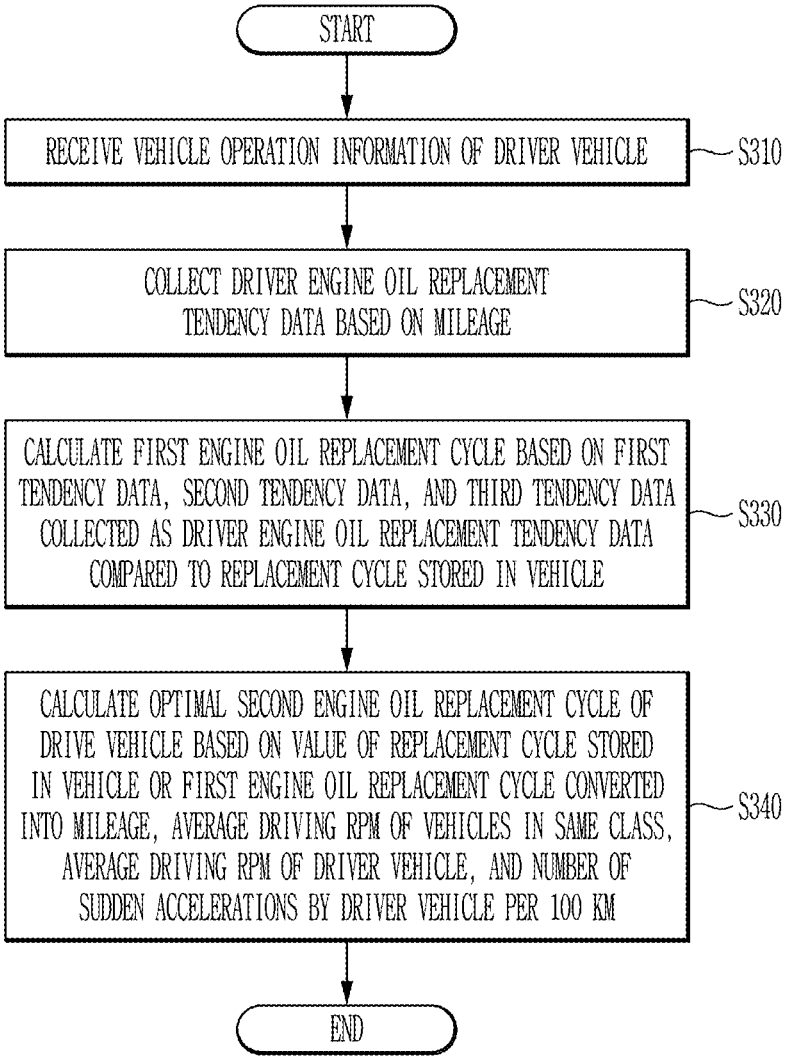
FIGS. 3 and 4 are flowcharts of an engine oil replacement cycle optimization method according to an embodiment of the present disclosure.
Figure 4:
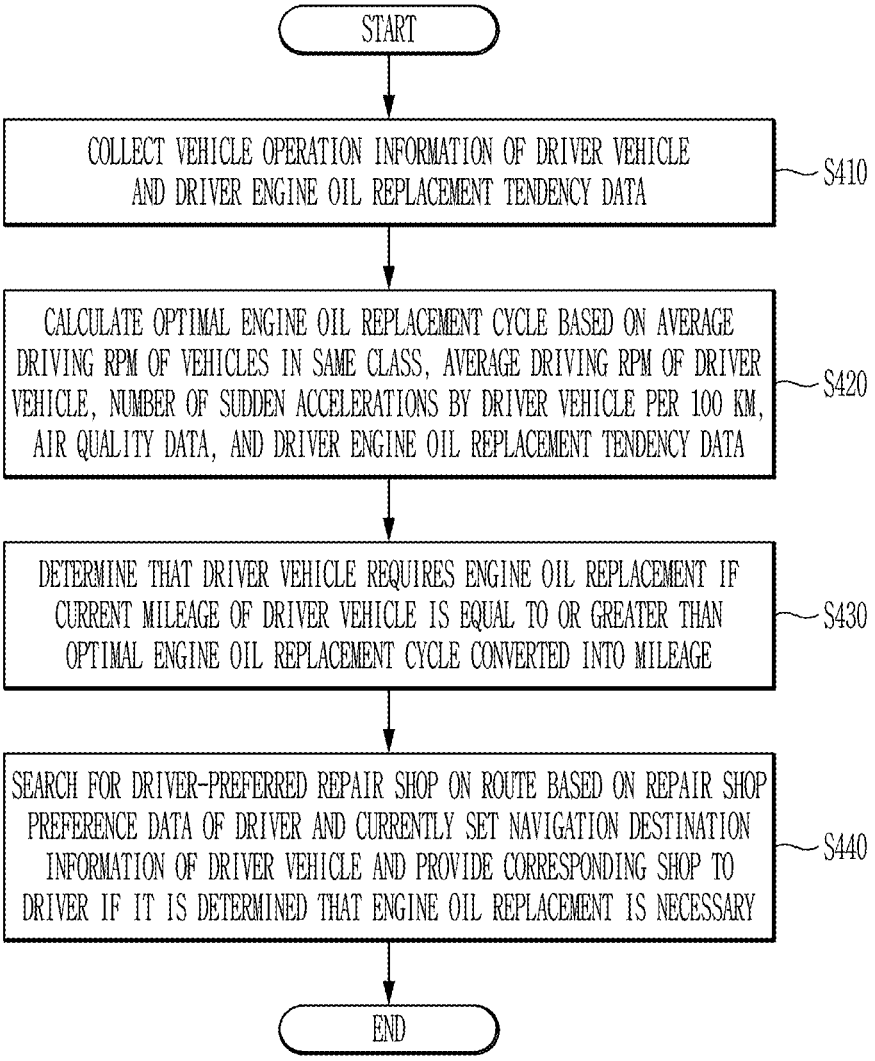

FIGS. 3 and 4 are flowcharts of an engine oil replacement cycle optimization method according to an embodiment of the present disclosure. The engine oil replacement cycle optimization method shown in FIGS. 3 and 4 may be performed by the engine oil replacement cycle optimization apparatus 100 in FIG. 1.

As shown in FIG. 3, the engine oil replacement cycle optimization apparatus 100 may receive the vehicle operation information of the driver vehicle (S310).

The engine oil replacement cycle optimization apparatus 100 may receive the vehicle operation information including at least the mileage, operation time, vehicle speed, and RPM information of the driver vehicle.

The engine oil replacement cycle optimization apparatus 100 may receive the average driving RPM of the driver vehicle, the average driving RPM of the vehicle in the same class, and the number of sudden accelerations by the driver vehicle per 100 km of driving.

The engine oil replacement cycle optimization apparatus 100 may collect the driver engine oil replacement tendency data based on the mileage (S320).

The engine oil replacement cycle optimization apparatus 100 may collect the first tendency data as the driver engine oil replacement tendency data when the average engine oil replacement period of the driver is shorter than the replacement cycle stored in the vehicle, the second tendency data when the average engine oil replacement period of the driver is longer than the stored replacement cycle, and the third tendency data when the stored replacement cycle and the average engine oil replacement period of the driver are the same (e.g., as each other).

The engine oil replacement cycle optimization apparatus 100 may calculate the engine oil replacement cycle of the driver vehicle based on at least one of the vehicle operation information or the engine oil replacement tendency data.

The engine oil replacement cycle optimization apparatus 100 may calculate the first engine oil replacement cycle based on the first tendency data, the second tendency data, and the third tendency data collected as the driver engine oil replacement tendency data compared to the replacement cycle stored in the vehicle (S330).

The engine oil replacement cycle optimization apparatus 100 may calculate the first engine oil replacement cycle of the driver vehicle based on (e.g., any) one of the first tendency data, the second tendency data, and the third tendency data.

The engine oil replacement cycle optimization apparatus 100 may calculate the optimal second engine oil replacement cycle of the driver vehicle based on the value of the replacement cycle stored in the vehicle or the first engine oil replacement cycle converted into the mileage, the average driving RPM of the vehicle in the same class, the average driving RPM of the driver vehicle, and the number of sudden accelerations by the driver vehicle per 100 km (S340).

In an embodiment, the engine oil replacement cycle optimization apparatus 100 may calculate the second engine oil replacement cycle converted into the mileage of the driver vehicle using Equation 1.

Equation 1 is $P=A\times(C/B)\times(1+0.001\times D)$

In Equation 1, P indicates the second engine oil replacement cycle converted into the mileage, A indicates the value of the replacement cycle stored in the vehicle or the first engine oil replacement cycle converted into the mileage, B indicates the average driving RPM of the vehicle in the same class, C indicates the average driving RPM of the driver vehicle, and D indicates the number of sudden accelerations by the driver vehicle per 100 km.

The engine oil replacement cycle optimization apparatus 100 may receive the air quality data collected from the vehicle.

The engine oil replacement cycle optimization apparatus 100 may calculate the engine oil replacement cycle of the driver vehicle based on the driver engine oil replacement tendency data, the vehicle operation information, or the air quality data.

That is, the engine oil replacement cycle optimization apparatus 100 may calculate the third engine oil replacement cycle converted into the mileage using Equation 2.

Equation 2 is $P=A\times(C/B)\times(1+0.001\times(D+E))$

In Equation 2, P indicates the third engine oil replacement cycle converted into the mileage, A indicates the value of the mileage-based replacement cycle stored in the vehicle or the first engine oil replacement cycle converted into the mileage, B indicates the average driving RPM of the vehicle in the same class, C indicates the average driving RPM of the driver vehicle, D indicates the number of sudden accelerations by the driver vehicle per 100 km, and E indicates the air quality data.

As shown in FIG. 4, the engine oil replacement cycle optimization apparatus 100 may collect the vehicle operation information of the driver vehicle and the driver engine oil replacement tendency data (S410).

The engine oil replacement cycle optimization apparatus 100 may calculate the optimal engine oil replacement cycle based on the average driving RPM of the vehicle in the same class, the average driving RPM of the driver vehicle, the number of sudden accelerations by the driver vehicle per 100 km, the air quality data, and the driver engine oil replacement tendency data (S420).

The engine oil replacement cycle optimization apparatus 100 may determine that the driver vehicle is due for (e.g., requires) the engine oil replacement if the current mileage of the driver vehicle is equal to or greater than the optimal engine oil replacement cycle converted into the mileage (S430).

The engine oil replacement cycle optimization apparatus 100 may search for the driver-preferred repair shop on the route based on the repair shop preference data of the driver and the (e.g., currently) set navigation destination information of the driver vehicle and provide the corresponding shop to the driver if it is determined that the engine oil replacement is due (e.g., necessary) (S440).

The engine oil replacement cycle optimization apparatus 100 may receive the vehicle operation information, the driver engine oil replacement tendency data, the first engine oil replacement cycle, and the second engine oil replacement cycle from the driver vehicle and store the same in the integrated database.

Figure 5:
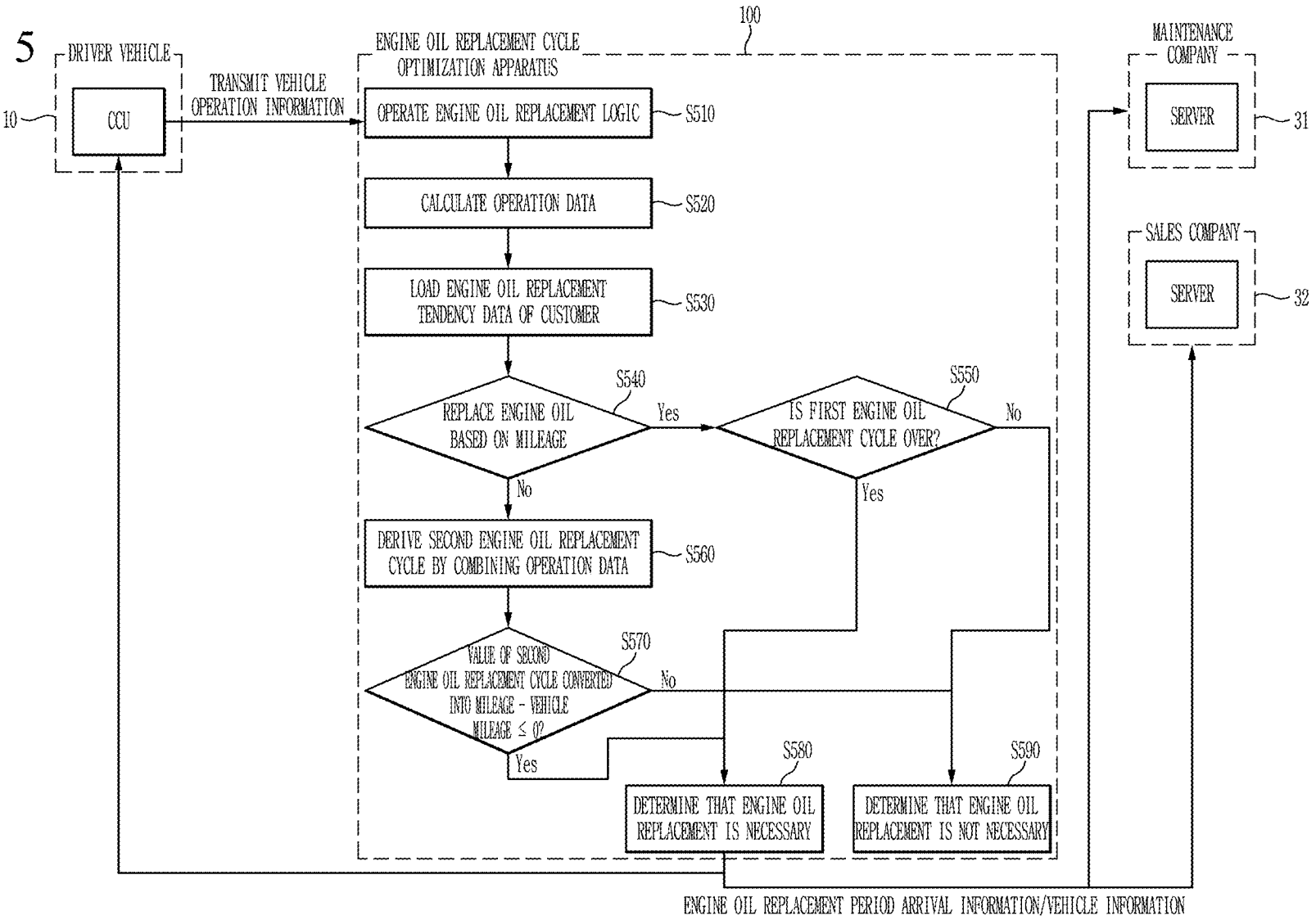
FIGS. 5, 6, and 7 are flowcharts of an engine oil replacement cycle optimization method according to an embodiment of the present disclosure.
Figure 6:
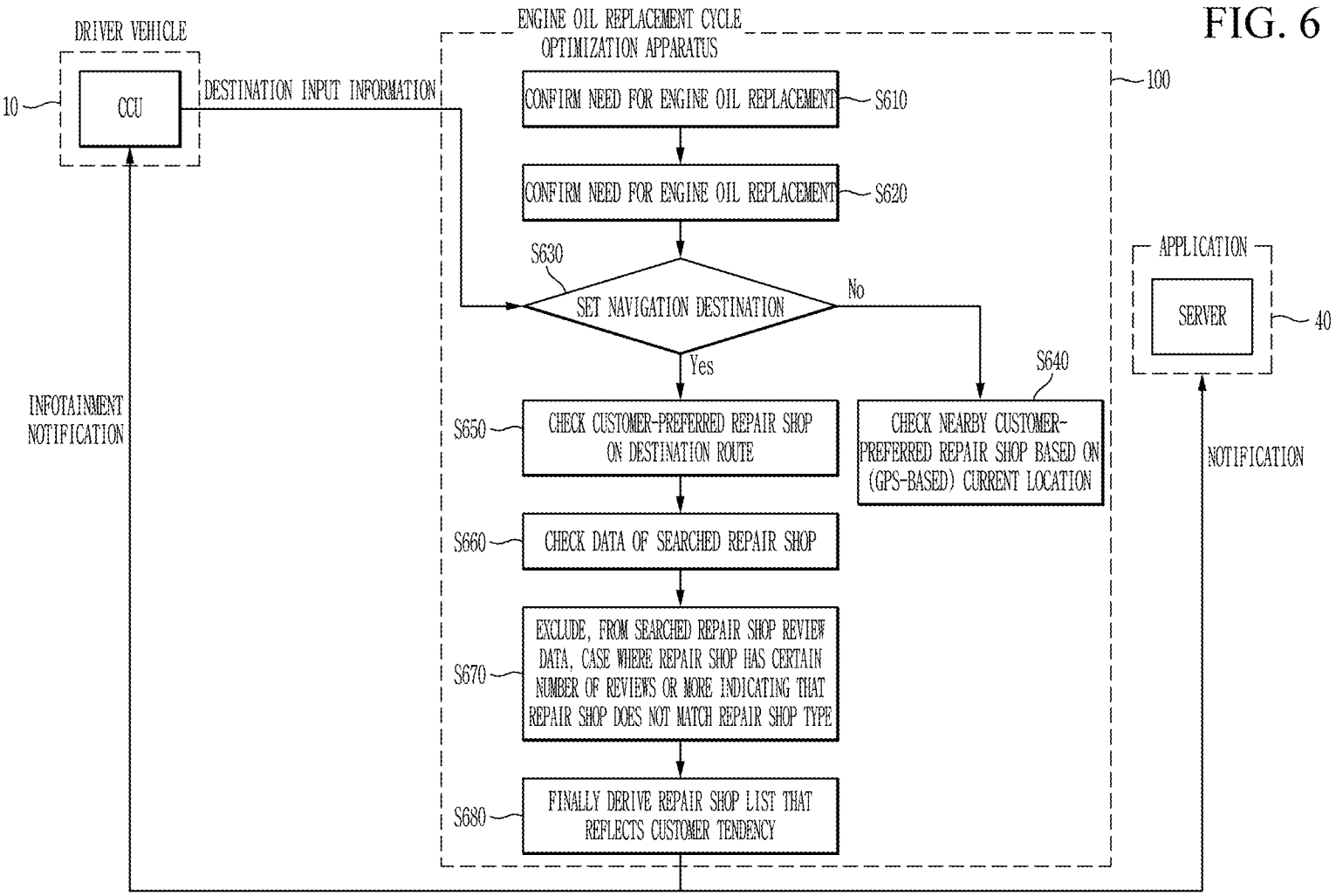
Figure 7:
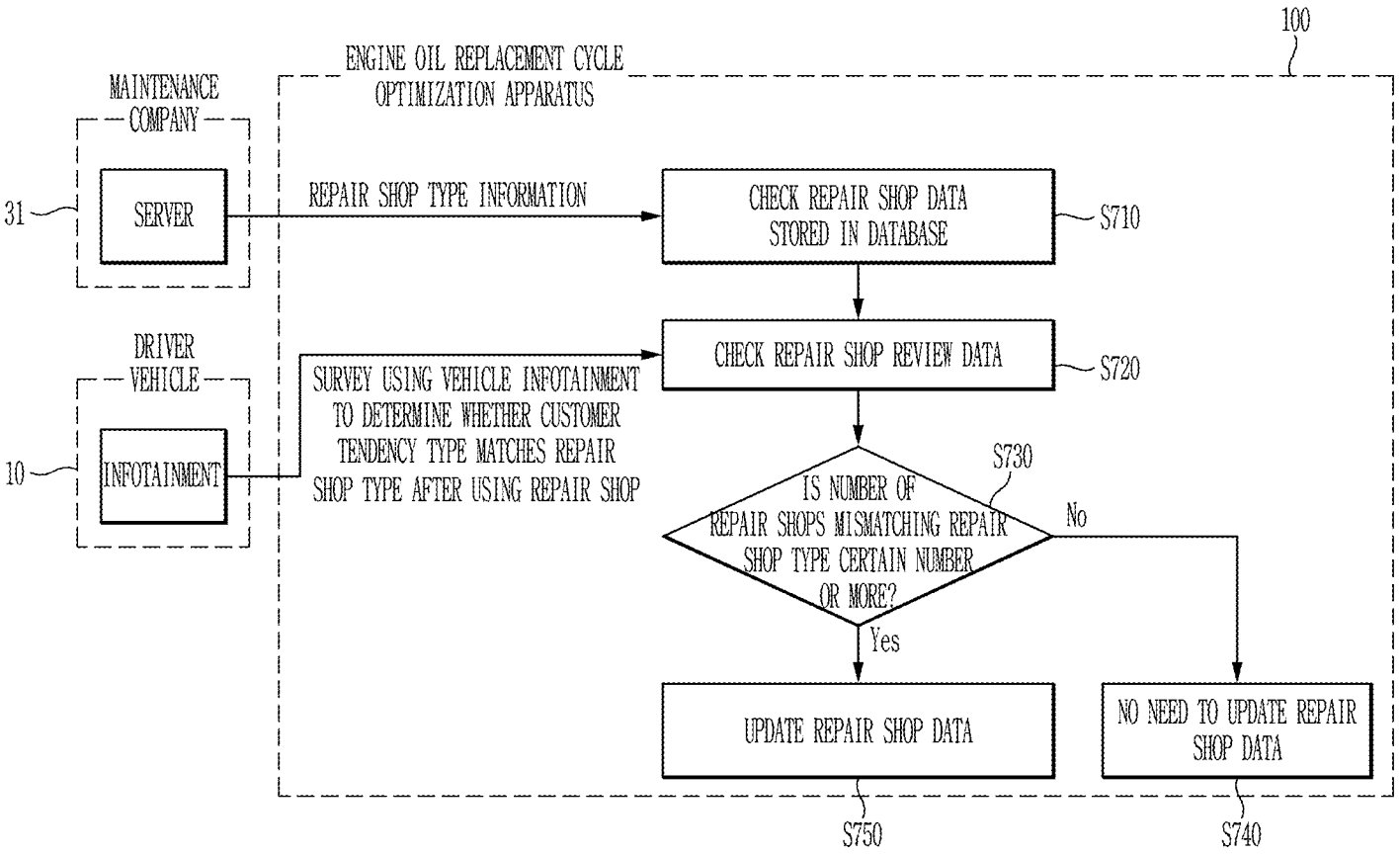

FIGS. 5, 6, and 7 are flowcharts of an engine oil replacement cycle optimization method according to an embodiment of the present disclosure. The engine oil replacement cycle optimization method may be performed by the engine oil replacement cycle optimization apparatus 100.

As shown in FIG. 5, the engine oil replacement cycle optimization apparatus 100 may receive the vehicle operation information from a central communication unit (CCU) of the driver vehicle 10.

The engine oil replacement cycle optimization apparatus 100 may operate (e.g., logic) using the engine oil replacement cycle optimization method according to an embodiment based on the driver vehicle operation information and the driver information received from the driver vehicle (S510).

The engine oil replacement cycle optimization apparatus 100 may calculate operation data including the average driving RPM of the driver vehicle, the average driving RPM of the vehicle in the same class, and the number of sudden accelerations by the driver vehicle per 100 km of driving (S520).

The engine oil replacement cycle optimization apparatus 100 may load the engine oil replacement tendency data of the driver (e.g., customer) together with the vehicle operation information from the CCU (S530).

The engine oil replacement cycle optimization apparatus 100 may (e.g., first) determine whether to replace the engine oil based on the first engine oil replacement cycle (e.g., automatically) calculated based on at least one of the driver vehicle operation information and the driver engine oil replacement tendency data (S540).

The first engine oil replacement cycle determined based on the driver engine oil replacement tendency data may be shorter or longer than the engine oil replacement cycle stored in the driver vehicle. The first engine oil replacement cycle may be calculated as the value converted into the mileage.

The engine oil replacement cycle optimization apparatus 100 may check whether the first engine oil replacement cycle is over if the engine oil replacement is determined based on the first engine oil replacement cycle (S550).

The engine oil replacement cycle optimization apparatus 100 may determine that the engine oil replacement is due (e.g., necessary) if the first engine oil replacement cycle is over (S580).

The engine oil replacement cycle optimization apparatus 100 may determine that engine oil replacement is not due (e.g., necessary) if the first engine oil replacement cycle is not over (S590).

The engine oil replacement cycle optimization apparatus 100 may calculate the second engine oil replacement cycle using Equation 1 or Equation 2 described with reference to FIG. 3 based on the operation data of the driver vehicle and the driver engine oil replacement tendency, in the case of not determining whether to replace the engine oil based on the first engine oil replacement cycle (S560).

The engine oil replacement cycle optimization apparatus 100 may determine that the engine oil replacement is due (e.g., necessary) if the following value is less than or equal to 0 (S580) by determining whether a value acquired by subtracting a current vehicle mileage from the value of the calculated second engine oil replacement cycle converted into the mileage is less than or equal to 0 (S570).

The engine oil replacement cycle optimization apparatus 100 may determine that the engine oil replacement is not due (e.g., necessary) if the value is greater than 0 (S590).

That is, the engine oil replacement cycle optimization apparatus 100 may determine the engine oil replacement if the value of the calculated second engine oil replacement cycle converted into the mileage is greater than or equal to the mileage of the current vehicle.

The engine oil replacement cycle optimization apparatus 100 may transmit the corresponding information to the CCU of the driver vehicle 10 if it is determined that engine oil replacement is due (e.g., necessary).

The engine oil replacement cycle optimization apparatus 100 may (e.g., simultaneously) transmit the information to a server of an external maintenance company 31 and a server of a sales company 32.

As shown in FIG. 6, the engine oil replacement cycle optimization apparatus 100 may confirm this need if it is determined as shown in FIG. 5 that the engine oil replacement of the driver vehicle is due (e.g., necessary), and the corresponding information is transmitted to the CCU of the driver vehicle, the external maintenance company, and the sales company (S610).

The engine oil replacement cycle optimization apparatus 100 may check the repair shop preference data of the customer, who is the driver, based on the driver engine oil replacement tendency data (S620).

The repair shop preference data of the driver may include information on whether the driver prefers an official service center, a private company, or self-maintenance.

The engine oil replacement cycle optimization apparatus 100 may determine whether to set a navigation destination (S630). Here, the engine oil replacement cycle optimization apparatus 100 may receive destination input information input by the driver using the CCU of the driver vehicle 10.

The engine oil replacement cycle optimization apparatus 100 may search for a nearby customer-preferred repair shop based on a global positioning system (GPS)-based current location of the driver vehicle if the navigation destination setting is not present (S640).

The engine oil replacement cycle optimization apparatus 100 may search for the customer-preferred repair shop on the destination route if the destination set by navigation is present (S650).

The engine oil replacement cycle optimization apparatus 100 may check the repair shop data of the searched repair shops (S660). The repair shop data may include review data for maintenance.

That is, the engine oil replacement cycle optimization apparatus 100 may check whether the repair shops searched for using the repair shop data of the repair shop match a customer-preferred repair shop type and other evaluations for the repair shops.

The engine oil replacement cycle optimization apparatus 100 may exclude the repair shop having a (e.g., certain)

number of cases or more from the searched repair shops by identifying the number of reviews in which the repair shop type included in the repair shop data does not match an actual repair shop type (S670).

The engine oil replacement cycle optimization apparatus 100 may (e.g., finally) generate a repair shop list that reflects the customer tendency (S680).

The engine oil replacement cycle optimization apparatus 100 may provide the generated repair shop list to the driver by using infotainment of the driver vehicle 10 and an application 40 of a user terminal.

FIG. 7 is a flowchart showing a method of the engine oil replacement cycle optimization apparatus for updating repair shop data according to an embodiment.

As shown in FIG. 7, the engine oil replacement cycle optimization apparatus 100 may check the information of the repair shop including the repair shop type based on the repair shop data stored in the database storing repair shop type information received from a server of a repair shop (e.g., maintenance company) 31 (S710).

The engine oil replacement cycle optimization apparatus 100 may receive, from the driver vehicle 10, survey data written by the driver after using the repair shop collected using the infotainment of the driver vehicle 10.

The engine oil replacement cycle optimization apparatus 100 may check repair shop review data including the survey data (S720).

The engine oil replacement cycle optimization apparatus 100 may collect a case where the repair shop type registered in the repair shop data of the repair shop (e.g., actually) does not match the driver tendency based on the repair shop review data, and determine whether the number of cases is a (e.g., certain or given) number or more (S730).

The engine oil replacement cycle optimization apparatus 100 may not update the repair shop data if the number of cases is the (e.g., certain) number or less (S740).

The engine oil replacement cycle optimization apparatus 100 may update the repair shop data if the number of cases is the (e.g., certain) number or more (S750).

Figure 8:
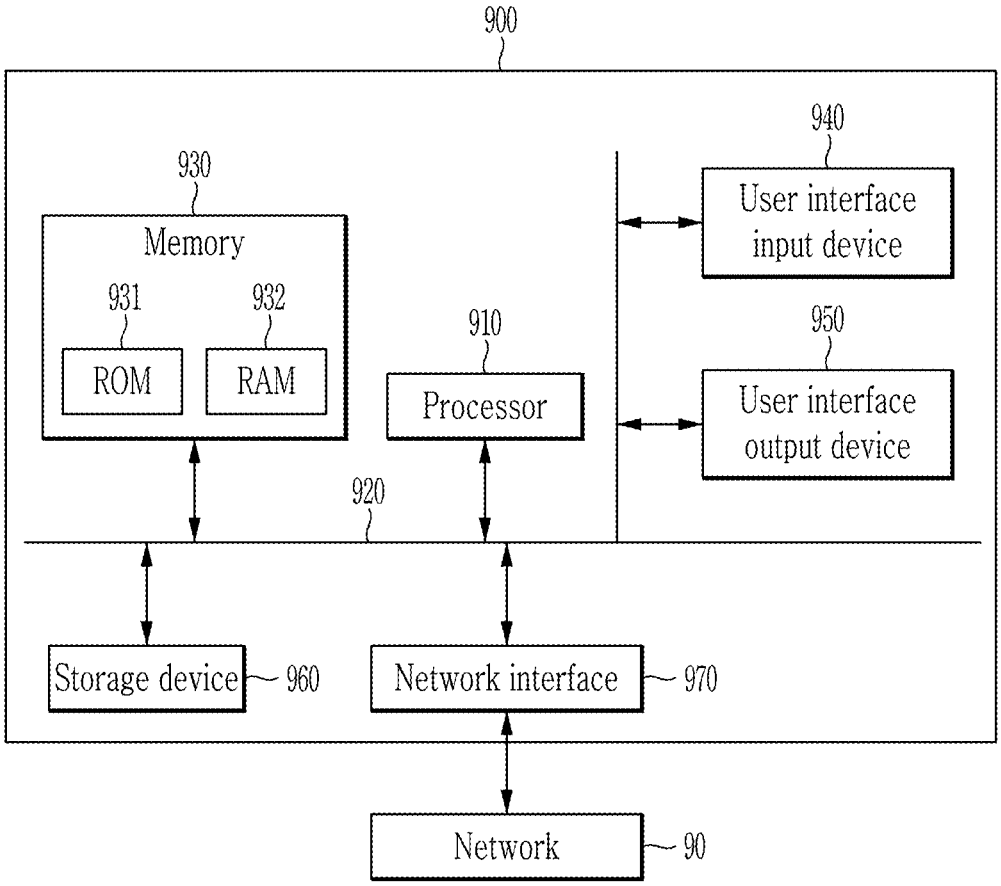
FIG. 8 is a diagram of a computing device according to an embodiment of the present disclosure.

FIG. 8 is a diagram for describing a computing device according to an embodiment of the present disclosure.

Referring to FIG. 8, the engine oil replacement cycle optimization apparatus and method according to the embodiments may be implemented using a computing device 900.

The computing device 900 may include at least one of a processor 910, a memory 930, a user interface input device 940, a user interface output device 950, and a storage device 960, performing their communications with one another using a bus 920. The computing device 900 may also include a network interface 970 electrically connected to a network 90. The network interface 970 may transmit or receive a signal with another entity through the network 90.

The processor 910 may be implemented in (e.g., any of) various types such as a micro controller unit (MCU), an application processor (AP), a central processing unit (CPU), a graphic processing unit (GPU), a neural processing unit (NPU), and the memory 930 may be (e.g., any) semiconductor device executing an instruction stored in the storage device 960. The processor 910 may be configured to implement the functions and methods described above with respect to FIGS. 1 to 7.

The memory 930 and the storage device 960 may include various types of volatile or non-volatile storage media. For example, the memory may include a read-only memory (ROM) 931 and a random access memory (RAM) 932. In this embodiment, the memory 930 may be disposed inside or outside the processor 910, and may be connected to the processor 910 through various means that are well-known.

In some embodiments, at least some components or functions of the engine oil replacement cycle optimization apparatus and method according to the embodiments may be implemented as a program or software executed on a computing device 900, and the program or software may be stored in a computer-readable medium.

In some embodiments, at least some components or functions of the engine oil replacement cycle optimization apparatus and method according to the embodiments may be implemented using the hardware or circuitry of the computing device 900, or implemented using a separate hardware or circuitry that may be electrically connected to the computing device 900.

Although the embodiments of the present disclosure have been described in detail hereinabove, the scope of the present disclosure is not limited thereto. That is, various modifications and alterations made by those skilled in the art to which the present disclosure pertains by using a basic concept of the present disclosure as defined in the following claims also fall within the scope of the present disclosure.

What is claimed is:

1. An engine oil replacement cycle optimization method comprising: receiving vehicle operation information including at least mileage, operation time, vehicle speed, and revolutions per minute (RPM) information of a driver vehicle;

collecting driver engine oil replacement tendency data based on the mileage;

calculating an engine oil replacement cycle of the driver vehicle based on at least one of the vehicle operation information or the engine oil replacement tendency data;

wherein receiving the vehicle operation information includes receiving an average driving RPM of the driver vehicle, an average driving RPM of a vehicle in the same class, and a number of sudden accelerations by the driver vehicle per 100 km of driving; and, wherein collecting the driver engine oil replacement tendency data based on the mileage includes collecting first tendency data as the driver engine oil replacement tendency data when an average engine oil replacement period is shorter than the replacement cycle stored in the vehicle, collecting second tendency data when the average engine oil replacement period is longer than the replacement cycle, and collecting third tendency data when the replacement cycle and the average engine oil replacement period are the same.

2. The method of claim 1, wherein calculating the engine oil replacement cycle of the driver vehicle includes calculating a first engine oil replacement cycle of the driver vehicle based on the first tendency data, the second tendency data, or the third tendency data.

3. The method of claim 2, wherein calculating of the engine oil replacement cycle of the driver vehicle includes calculating a second engine oil replacement cycle converted into the mileage of the driver vehicle using an equation of $P=A\times(C/B)\times(1+0.001\times D)$, wherein P indicates the second engine oil replacement cycle converted into the mileage, A indicates a value of the replacement cycle stored in the vehicle or the first engine oil replacement cycle converted into the mileage, B indicates the average driving RPM of the vehicle in the same class, C indicates the average driving RPM of the driver vehicle, and D indicates the number of sudden accelerations by the driver vehicle per 100 km.

4. The method of claim 3, further comprising determining that the driver vehicle is due for engine oil replacement if a current mileage of the driver vehicle is equal to or greater than the first engine oil replacement cycle converted into the mileage or the second engine oil replacement cycle converted into the mileage.

5. The method of claim 4, wherein searching for a driver-preferred repair shop on a route and providing the repair shop to the driver is based on repair shop preference data of the driver included in the driver engine oil replacement tendency data, and further comprises setting navigation destination information of the driver vehicle if it is determined that the engine oil replacement is due.

6. The method of claim 2, further comprising receiving air quality data collected from the vehicle, wherein calculating of the engine oil replacement cycle of the driver vehicle includes calculating the engine oil replacement cycle of the driver vehicle based on the driver engine oil replacement tendency data, the vehicle operation information, or the air quality data.

7. The method of claim 6, wherein calculating of the engine oil replacement cycle of the driver vehicle includes calculating a third engine oil replacement cycle converted into the mileage using an equation of $P=A\times(C/B)\times(1+0.001\times(D+E))$, wherein P indicates the third engine oil replacement cycle converted into the mileage, A indicates a value of the replacement cycle stored in the vehicle or the first engine oil replacement cycle converted into the mileage, B indicates the average driving RPM of the vehicle in the same class, C indicates the average driving RPM of the driver vehicle, D indicates the number of sudden accelerations by the driver vehicle per 100 kin, and E indicates the air quality data.

8. The method of claim 1, further comprising receiving the vehicle operation information, the driver engine oil replacement tendency data, a first engine oil replacement cycle, and a second engine oil replacement cycle from the driver vehicle and storing received information in an integrated database.

9. An engine oil replacement cycle optimization apparatus comprising:

a vehicle operation information receiving unit for receiving vehicle operation information including at least mileage, operation time, vehicle speed, and revolutions per minute (RPM) information of a driver vehicle, a driver tendency collection unit for collecting driver engine oil replacement tendency data based on the mileage, an engine oil replacement period determination unit for calculating an engine oil replacement cycle of the driver vehicle based on at least one of the vehicle operation information or the engine oil replacement tendency data;

wherein the vehicle operation information receiving unit receives an average driving RPM of the driver vehicle, an average driving RPM of a vehicle in the same class, and a number of sudden accelerations by the driver vehicle per 100 km of driving; and, wherein the driver tendency collection unit receives first tendency data as the driver engine oil replacement tendency data when an average engine oil replacement period is shorter than the replacement cycle stored in the vehicle, receives second tendency data when the average engine oil replacement period is longer than the replacement cycle, and receives third tendency data when the replacement cycle and the average engine oil replacement period are the same.

10. The apparatus of claim 9, wherein the engine oil replacement period determination unit calculates a first engine oil replacement cycle of the driver vehicle based on the first tendency data, the second tendency data, or the third tendency data.

11. The apparatus of claim 10, wherein the engine oil replacement period determination unit calculates a second engine oil replacement cycle converted into the mileage of the driver vehicle using an equation of $P=A\times(C/B)\times(1-0.001\times D)$, wherein P indicates the second engine oil replacement cycle converted into the mileage, A indicates a value of the replacement cycle stored in the vehicle or the first engine oil replacement cycle converted into the mileage, B indicates the average driving RPM of the vehicle in the same class, C indicates the average driving RPM of the driver vehicle, and D indicates the number of sudden accelerations by the driver vehicle per 100 km.

12. The apparatus of claim 11, wherein the vehicle operation information receiving unit receives air quality data collected from the vehicle, and the engine oil replacement period determination unit calculates a third engine oil replacement cycle of the driver vehicle based on the driver engine oil replacement tendency data, the vehicle operation information, or the air quality data.

13. The apparatus of claim 12, wherein the engine oil replacement period determination unit calculates the third engine oil replacement cycle converted into the mileage using an equation of $P=A\times(C/B)\times(1+0.001\times(D+E))$, wherein P indicates the third engine oil replacement cycle converted into the mileage, A indicates a value of the replacement cycle stored in the vehicle or the first engine oil replacement cycle converted into the mileage, B indicates the average driving RPM of the vehicle in the same class, C indicates the average driving RPM of the driver vehicle, D indicates the number of sudden accelerations by the driver vehicle per 100 kin, and E indicates the air quality data.

14. The apparatus of claim 10, further comprising a repair shop recommendation unit for determining that the driver vehicle is due for engine oil replacement if a current mileage of the driver vehicle is equal to or greater than the first engine oil replacement cycle converted into mileage or the second engine oil replacement cycle converted into the mileage.

15. The apparatus of claim 14, wherein the repair shop recommendation unit searches for a driver-preferred repair shop on a route and provides the repair shop to the driver based on repair shop preference data of the driver that is included in the driver engine oil replacement tendency data and set navigation destination information of the driver vehicle if it is determined that the engine oil replacement is due.

16. The apparatus of claim 9, wherein the vehicle operation information, the driver engine oil replacement tendency data, a first engine oil replacement cycle, and a second engine oil replacement cycle are received from the driver vehicle and stored in an integrated database.

* * * * *